US007231987B2

(12) United States Patent
Kilgore et al.

(10) Patent No.: US 7,231,987 B2
(45) Date of Patent: Jun. 19, 2007

(54) DEEP SET PACKER WITH HYDROSTATIC SETTING ACTUATOR

(75) Inventors: Marion D. Kilgore, Dallas, TX (US); Daniel L. Patterson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 352 days.

(21) Appl. No.: 10/803,020

(22) Filed: Mar. 17, 2004

(65) Prior Publication Data

US 2005/0205269 A1 Sep. 22, 2005

(51) Int. Cl.
*E21B 23/06* (2006.01)
*E21B 33/128* (2006.01)

(52) U.S. Cl. ..... 166/387; 166/120; 166/134

(58) Field of Classification Search ..... 166/120, 166/123, 134, 387
See application file for complete search history.

(56) References Cited

U.S. PATENT DOCUMENTS

| | | | | |
|---|---|---|---|---|
| 3,061,012 | A | 10/1962 | Moosman | |
| 3,139,140 | A | 6/1964 | Brown | |
| 3,239,009 | A | 3/1966 | Leutwyler | |
| 3,414,058 | A * | 12/1968 | De Rochemont | 166/120 |
| 4,098,335 | A * | 7/1978 | Goad | 166/120 |
| 4,505,332 | A | 3/1985 | Mills et al. | |
| 4,716,963 | A | 1/1988 | George et al. | |
| 4,745,971 | A * | 5/1988 | Akkerman | 166/120 |
| 4,754,814 | A | 7/1988 | Jordan, Jr. | |
| 5,425,418 | A | 6/1995 | Arizmendi et al. | |
| RE36,525 | E * | 1/2000 | Pringle | 166/120 |
| 7,090,027 | B1 * | 8/2006 | Williams | 166/386 |
| 2003/0132008 | A1 * | 7/2003 | Hirth et al. | 166/387 |
| 2003/0221837 | A1 * | 12/2003 | Giroux et al. | 166/373 |
| 2003/0226668 | A1 | 12/2003 | Zimmerman et al. | |

OTHER PUBLICATIONS

Baker Hughes, "APEX™ Big Bore Completion Solutions", dated 2004.
Baker Hughes, "Deepwater Upper Completions", dated 2004.
Schlumberger, TRC-DH Series,"Low-operating pressure, dual hydraulic pistons, flapper valves, working pressures to 15,000 psi", undated.
Halliburton, "Hydrostatic-Set Perma-Series® Production Packers", dated 2000.
Weatherford Completion Systems, "Packers, High-performance packers for the life of you well", dated 2002.
Halliburton, "Hydrostatic-Set Permanent Production Packers", undated.
Halliburton, "Hydrostatic-set Retrievable Production Packers", undated.
Halliburton, "Hydraulic-Set AVA™ RHD Dual Production Packer", undated.

* cited by examiner

*Primary Examiner*—Jennifer H. Gay
*Assistant Examiner*—Shane Bomar
(74) *Attorney, Agent, or Firm*—Marlin R. Smith

(57) ABSTRACT

A packer and actuator therefor configured for use in relatively high hydrostatic pressure environments. In a described embodiment, a packer for use in a subterranean well includes an actuator for setting the packer. The actuator includes multiple pistons circumferentially spaced apart from each other.

57 Claims, 5 Drawing Sheets

DEEP SET PACKER WITH HYDROSTATIC SETTING ACTUATOR

BACKGROUND

The present invention relates generally to equipment utilized and operations performed in conjunction with a subterranean well and, in an embodiment described herein, more particularly provides a deep set packer with hydrostatic setting actuator.

In relatively deep wells, sufficient hydrostatic pressure exists for use in setting a packer. Typical hydrostatic set packers for use in deep wells have actuators which include annular piston areas formed between concentric tubular members. Unfortunately, the large hydrostatic pressures found in deep wells tend to deform these concentric tubular members, so that the actuators are unable to operate satisfactorily. For example, using conventional hydrostatic set packers it has not yet been possible to satisfactorily set the packers at pressures greater than 19,000 psi.

Therefore, it may be seen that it would be very beneficial to provide improved hydrostatic set packers for use in deep wells.

SUMMARY

In carrying out the principles of the present invention, in accordance with an embodiment thereof, a packer and an actuator therefor are provided which are configured for use in high hydrostatic pressure environments. Associated methods are also provided.

In one aspect of the invention, a packer for use in a subterranean well is provided. The packer includes an actuator for setting the packer. The actuator includes multiple pistons circumferentially spaced apart from each other.

In another aspect of the invention, an actuator for use in a well packer is provided. The actuator includes multiple pistons, each of which is received in a respective one of multiple bores. The actuator further includes a force transmission device. Each of the pistons is releasably coupled to the force transmission device.

In yet another aspect of the invention, a method of setting a packer in a subterranean well is provided. The method includes the steps of: increasing pressure on the packer in the well; and displacing multiple pistons relative to respective multiple bores of an actuator of the packer in response to the pressure increasing step, thereby setting the packer in the well.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
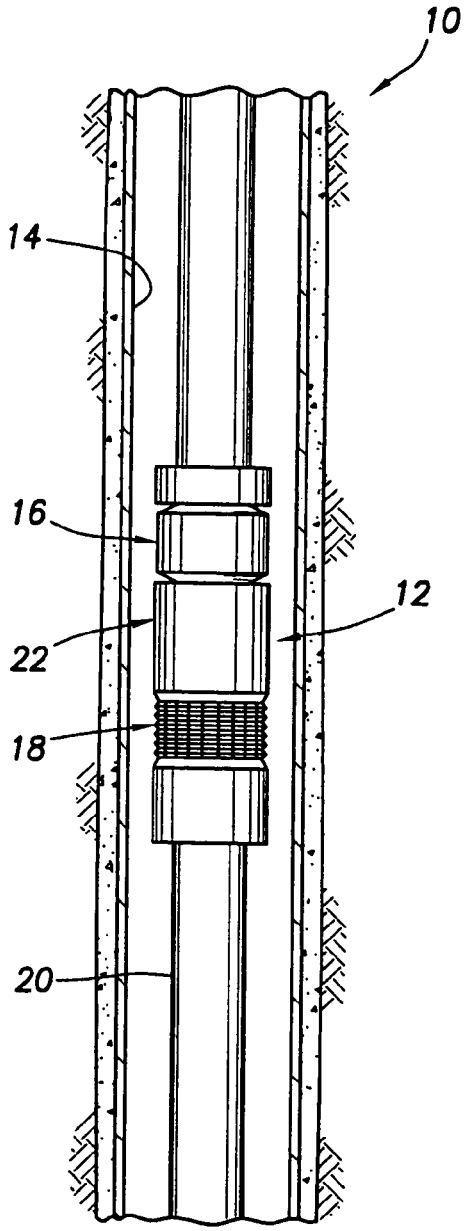
FIG. 1 is a schematic partially cross-sectional view of a well and a packer therein embodying principles of the present invention.

Representatively illustrated in FIG. 1 is a well 10 having a packer 12 therein which embodies principles of the present invention. In the following description of the packer 12 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the packer 12 is positioned in a cased wellbore 14 of the well 10. The packer 12 includes outwardly extendable seal elements 16 for sealingly engaging the wellbore 14. The packer 12 also includes a slip assembly 18 for grippingly engaging the wellbore 14.

Thus, the packer 12 is capable of both sealing and anchoring a tubular string 20 in the wellbore 14. Note that, although the wellbore 14 is depicted in FIG. 1 as being cased, the principles of the invention are also applicable to situations in which a wellbore is uncased.

In one beneficial feature of the packer 12, an actuator 22 of the packer is positioned longitudinally between the seal elements 16 and the slip assembly 18. The actuator 22 produces both upwardly and downwardly directed forces when it is actuated, and these forces are transmitted directly from the actuator to each of the seal elements 16 and the slip assembly 18. In this manner, the forces produced by the actuator 22 are more efficiently utilized in the packer 12 than in conventional hydrostatic set packers, resulting in more satisfactory and reliable sealing and anchoring of the tubular string 20.

However, it should be clearly understood that it is not necessary in keeping with the principles of the invention for the actuator 22 to be positioned between the seal elements 16 and the slip assembly 18. The actuator 22 could instead be positioned below the slip assembly 18 or above the seal elements 16, for example. The embodiments described herein are used only as examples to illustrate applications of the principles of the invention, and are not to be taken as limiting the invention.

Figure 2:
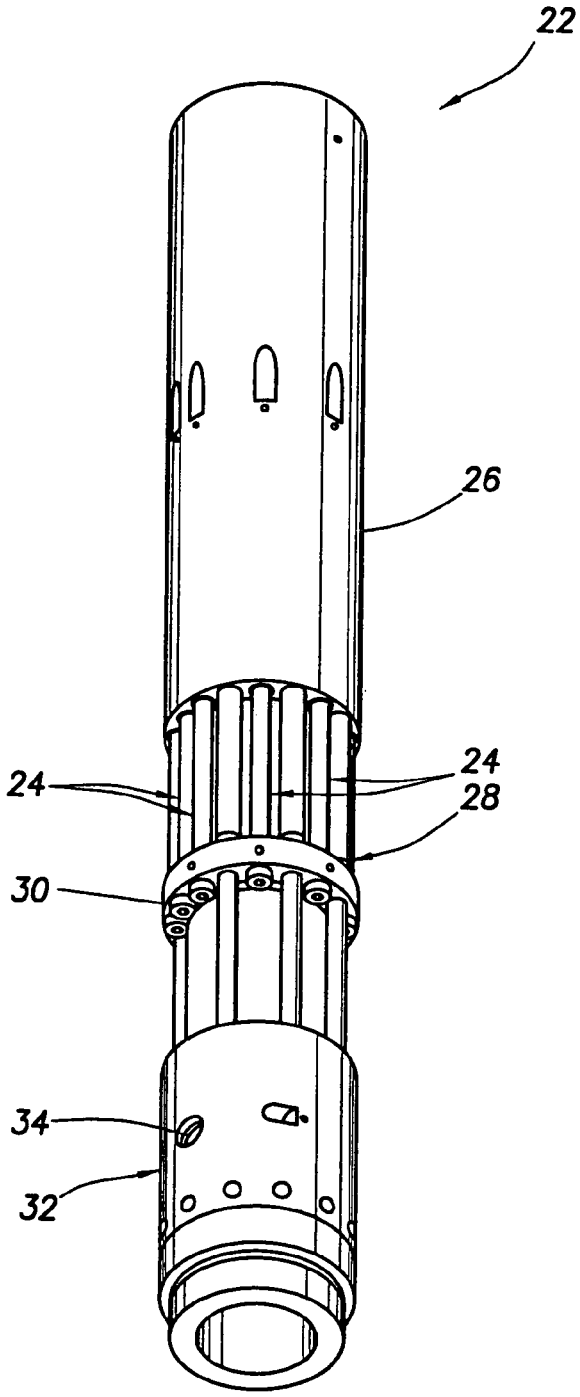
FIG. 2 is an enlarged scale isometric view of an actuator of the packer, depicted in a run-in configuration.

Referring additionally now to FIG. 2, the actuator 22 is representatively illustrated apart from the remainder of the packer 12. In this view it may be seen that the actuator 22 includes multiple pistons 24 (a total of ten in this embodiment) received and circumferentially spaced apart in a generally tubular or annular shaped structure 26. The pistons 24 are each releasably coupled to a force transmission device 28, which includes a ring 30 through which each of the pistons extends.

Furthermore, the actuator 22 includes a setting initiation device 32. This device 32 is used to prevent the actuator 22 from actuating until a predetermined pressure on the packer 12 is reached, at which point the device permits the actuator to actuate and set the packer. Prior to application of the predetermined pressure, pressure in the well 10 causes the pistons 24 to exert an upwardly directed biasing force on the ring 30, and also causes the device 32 to exert a downwardly directed biasing force on the ring.

The downwardly directed force is greater than the upwardly directed force. However, when the predetermined pressure is applied, a rupture disc 34 of the device 32 is ruptured, thereby exposing an atmospheric chamber 46 (see FIG. 6) of the device to pressure in the well 10. At this point, the device no longer exerts the downwardly directed force on the ring 30. These details of the actuator 22 are described more fully below.

Note that the chamber 46 may be at atmospheric pressure when the actuator 22 is initially installed, or it could be at another pressure which is less than the pressure expected in the well at the location at which the actuator is to be positioned when it is actuated. It is not necessary in keeping with the principles of the invention for the chamber 46 to be at atmospheric pressure at any particular time, although in a preferred embodiment, the chamber is at atmospheric pressure when the actuator 22 is installed in the well. However, another pressure could be used if desired, such as another pressure less than hydrostatic pressure in the well at the location where the actuator 22 is to be positioned.

Figure 3:
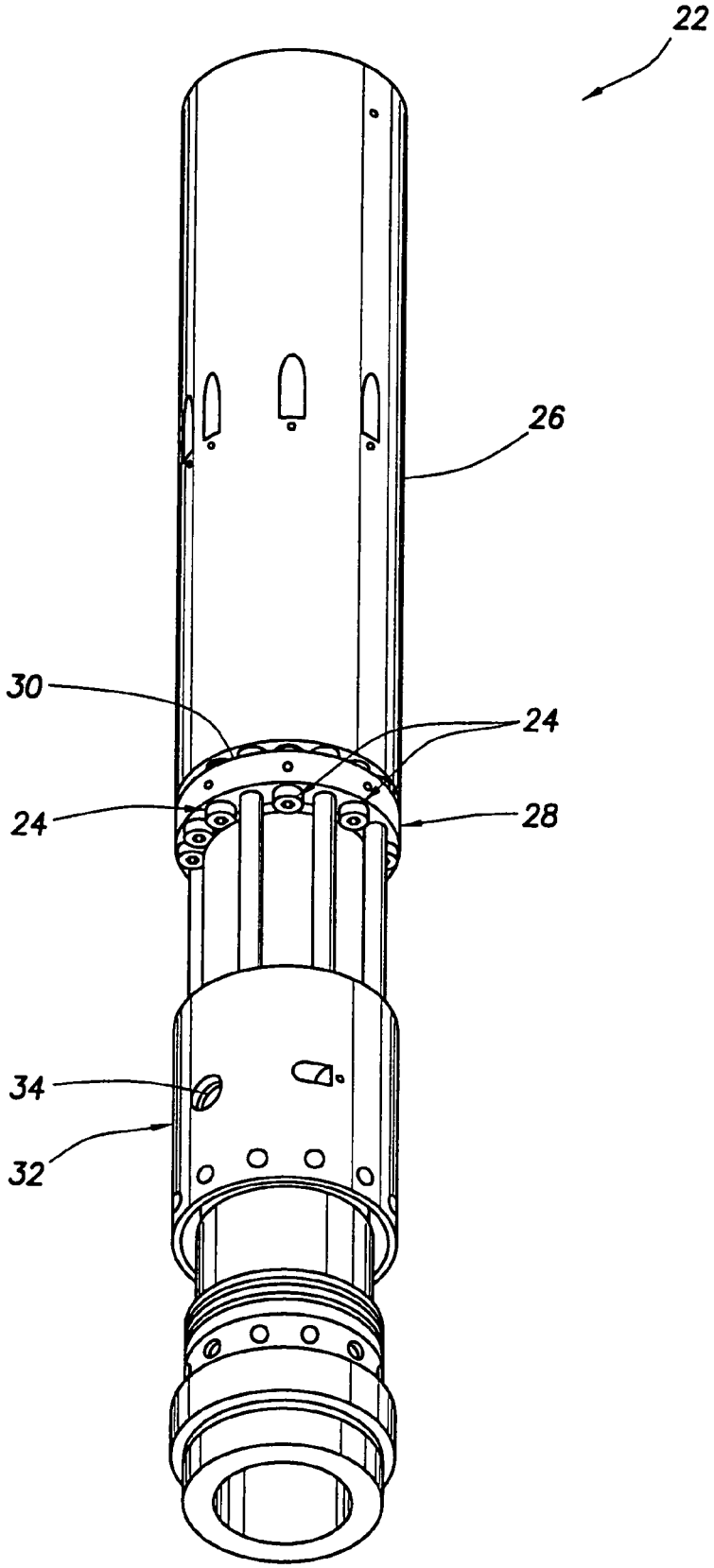
FIG. 3 is an isometric view of the actuator, depicted in an actuated configuration.

In FIG. 3, the actuator 22 is depicted in a configuration in which the rupture disc 34 has been ruptured. The biasing force exerted by the setting initiation device 32 is now reduced (or completely eliminated), so that the biasing force exerted by the pistons 24 has displaced the ring 30 upward to set the packer 12.

Upward displacement of any of the pistons 24 causes upward displacement of the ring 30. However, since each of the pistons 24 is releasably coupled to the ring 30, it is not necessary for all of the pistons to displace in order for the ring to displace. Thus, the ring 30 can displace upward with less than all of the pistons 24.

Figure 4:
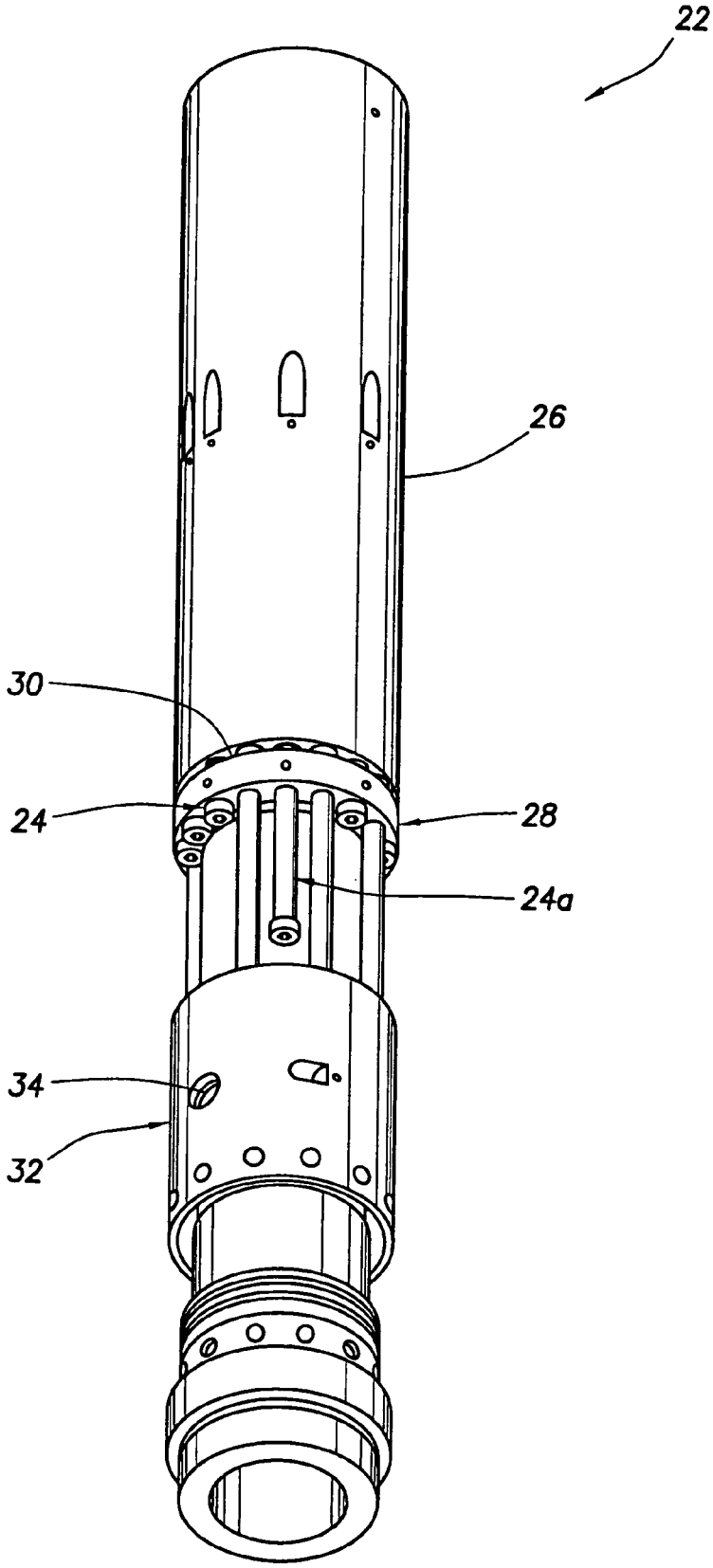
FIG. 4 is an isometric view of the actuator, depicted in the actuated configuration, but with a piston malfunction.

In FIG. 4, the actuator 22 is depicted in its actuated configuration, as in FIG. 3, but in this instance one of the pistons (indicated as element 24*a* in FIG. 4) has experienced a malfunction, so that it has not displaced upwardly with the ring 30 and the remainder of the pistons. The malfunction could be due to a leaking seal on the piston, a mechanical bind between the piston and a bore in which it is received, or any other cause.

This is a very beneficial feature of the actuator 22, since it still permits the actuator to set the packer 12, even though one or more of the pistons 24 experiences a malfunction. For example, if there are ten of the pistons 24 and one of them experiences a malfunction, then about 90% of the maximum setting force can still be output by the actuator 22 to set the packer 12. In deep wells, where a round trip to replace a malfunctioning packer is extraordinarily time-consuming and expensive, this feature is very desirable.

Figure 5:
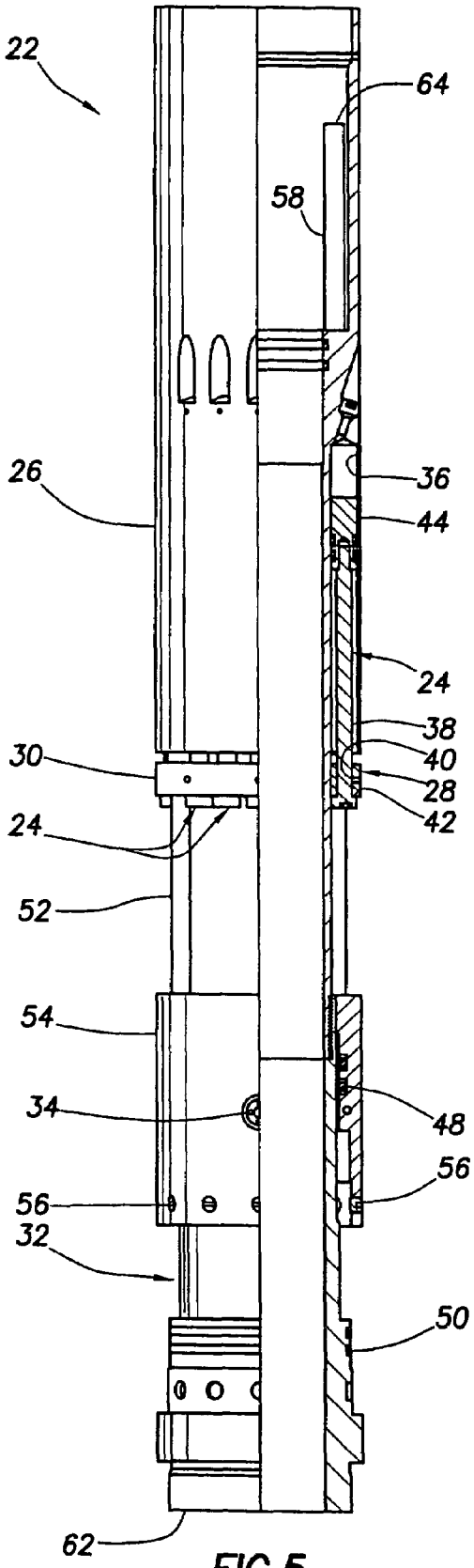
FIG. 5 is a quarter-sectional view of the actuator in the actuated configuration.
Figure 6:
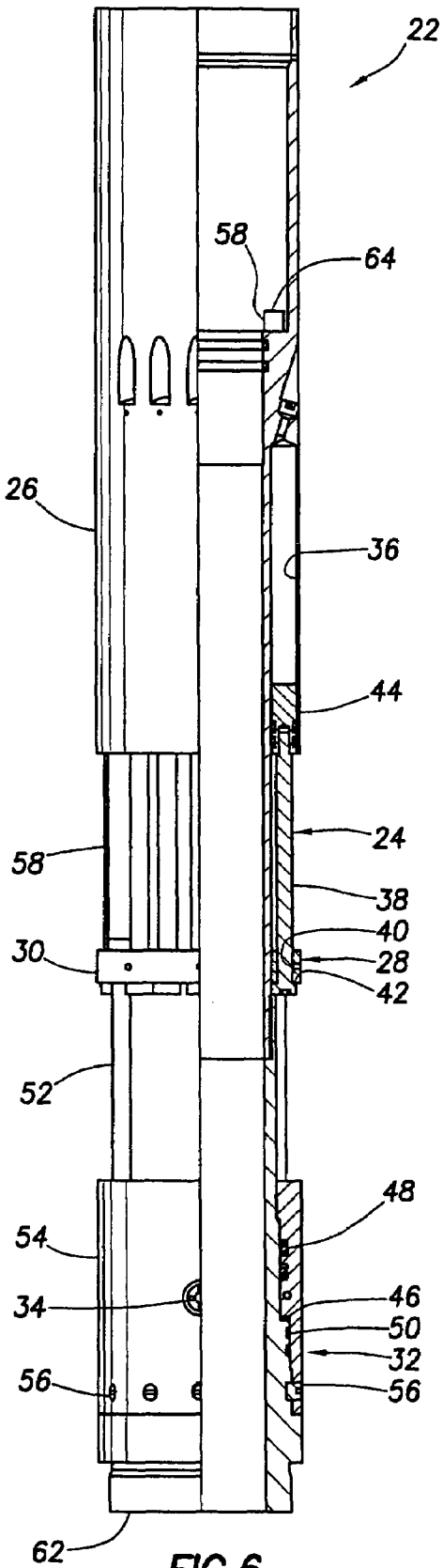
FIG. 6 is a quarter-sectional view of the actuator in the run-in configuration.

Referring additionally now to FIGS. 5 & 6, the actuator 22 is depicted in its actuated configuration (FIG. 5) and run-in configuration (FIG. 6) in quarter-sectional views. It may now be fully appreciated how the pistons 24 are received in bores 36 formed longitudinally in the tubular structure 26. In addition, it may be clearly seen how each piston 24 is releasably coupled to the ring 30.

Each piston 24 includes an elongated extension 38 which extends through a respective one of multiple openings 40 formed through the ring 30. The openings 40 are circumferentially spaced apart in the ring 30, corresponding to the spacing of the pistons 24 in the bores 36 of the structure 26. A shoulder 42 formed on each of the extensions 38 is larger than the opening 40 through which the extension 38 extends, so that upward displacement of the piston 24 causes the shoulder to engage the ring 30 and displace it upward with the piston. However, note that the ring 30 can be displaced upwardly without the piston 24 displacing upward.

Each of the pistons 24 is depicted as being made up of multiple elements, an extension 38 threaded into a seal-carrying member 44, but it will be appreciated that the pistons could be made up of more or less elements in keeping with the principles of the invention. The bores 36 in which the members 44 are received are separate from each other, and are preferably at atmospheric pressure when the actuator 22 is used with the packer 12 (i.e., an atmospheric chamber exists in each bore 36 above the member 44). Thus, each of the bores 36 may be separately pressure-checked prior to running the actuator 22 (e.g., by pulling a vacuum on the individual bores and checking for leakage), and a leak into one of the bores after running the actuator will not affect operation of the pistons 24 in the other bores.

Note that the bore 36 above each member 44 may be at atmospheric pressure when the actuator 22 is initially installed, or it could be at another pressure which is less than the pressure expected in the well at the location at which the actuator is to be positioned when it is actuated. It is not necessary in keeping with the principles of the invention for the bore 36 above each member 44 to be at atmospheric pressure at any particular time, although in a preferred embodiment, the bore above each member is at atmospheric pressure when the actuator 22 is installed in the well. However, another pressure could be used if desired, such as another pressure less than hydrostatic pressure in the well at the location where the actuator 22 is to be positioned.

Due to the unique construction and configuration of the actuator 22, the relatively small diameter multiple pistons 24 and bores 36 are not deformed significantly when exposed to high pressures in a well. By circumferentially spacing apart the bores 36 in the structure 26, the bores are supported by the sidewall of the structure surrounding each bore. In addition, since the pistons 24 are not annular-shaped, they are not deformed significantly by the pressure applied thereto. Thus, the actuator 22 is capable of satisfactory operation at pressures in excess of 19,000 pounds per square inch in a well.

The setting initiation device 32 includes the chamber 46 between two sets of seals 48, 50. It will be readily appreciated by one skilled in the art that, when pressure is applied to the actuator 22 in the well 10, and the setting initiation device 32 is in the configuration shown in FIG. 6, a downwardly directed force will be produced by the setting initiation device. Shoulder screws 52 (six in this embodiment) are threaded into an outer housing 54 of the setting initiation device 32 and extend through the ring 30 (similar to the manner in which the pistons 24 extend through the ring), in order to transfer the downwardly directed force to the ring.

When the predetermined pressure is reached, the rupture disk 34 ruptures, and the chamber 46 is exposed to the pressure in the well 10. Thus, the downwardly directed force formerly produced by the setting initiation device 32 is eliminated, and the upwardly directed force produced by the pistons 24 displaces the ring 30 upwardly (upon shearing shear screws 56 in the setting initiation device 32).

Positioned above each of the shoulder screws 52 is an elongated member 58 of the force transmission device 28. The force transmission device 28 includes six of the members 58 in this embodiment. The members 58 extend through respective openings 60 (see FIG. 7) formed longitudinally through the structure 26 and circumferentially spaced apart therein. Thus, as the ring 30 displaces upwardly, the members 58 displace upwardly, as well.

In FIG. 6 it may be seen that the ring 30 is in its downward position (prior to the predetermined pressure being applied) and in an upper portion of the illustration one of the members 58 is visible extending somewhat out of its respective opening 60 in the structure 26. In FIG. 5 it may be seen that the ring 30 is in its upwardly displaced position (after the predetermined pressure has ruptured the rupture disk 34) and in an upper portion of the illustration one of the members 58 is visible extending further out of its respective opening in the structure 26. This elongation of the actuator 22 from its lower end 62 to upper ends 64 of the members 58 is used to apply biasing forces to the seal element 16 and slip assembly 18 of the packer 12 in order to set the packer.

Figure 7:
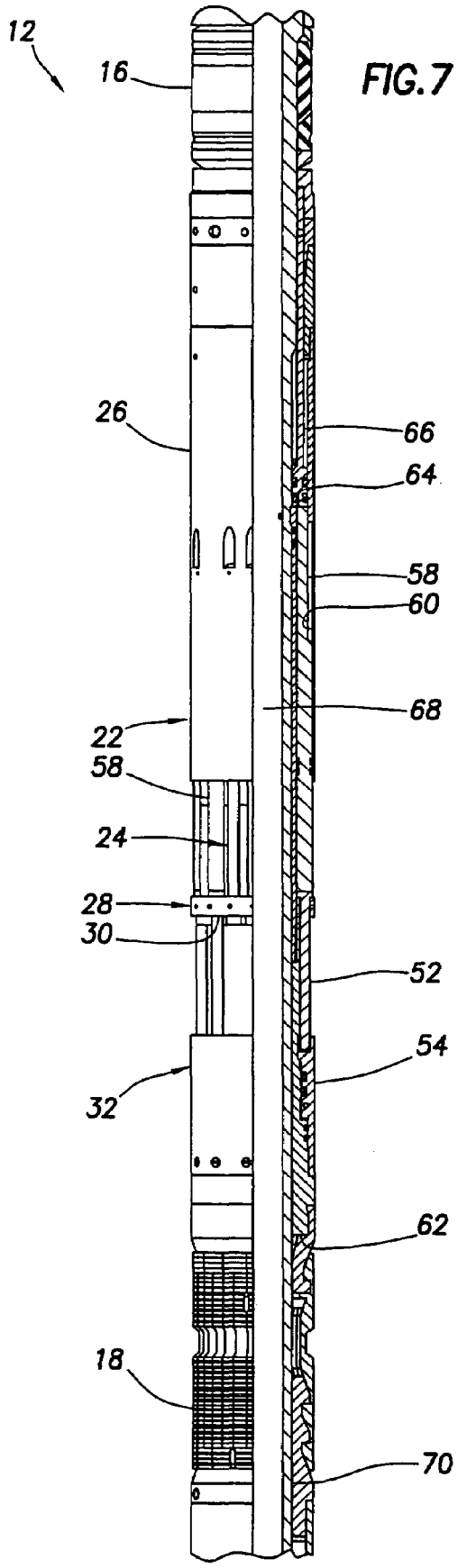
FIG. 7 is a quarter-sectional view of the packer, illustrating a force transmission arrangement of the packer.
Figure 8:
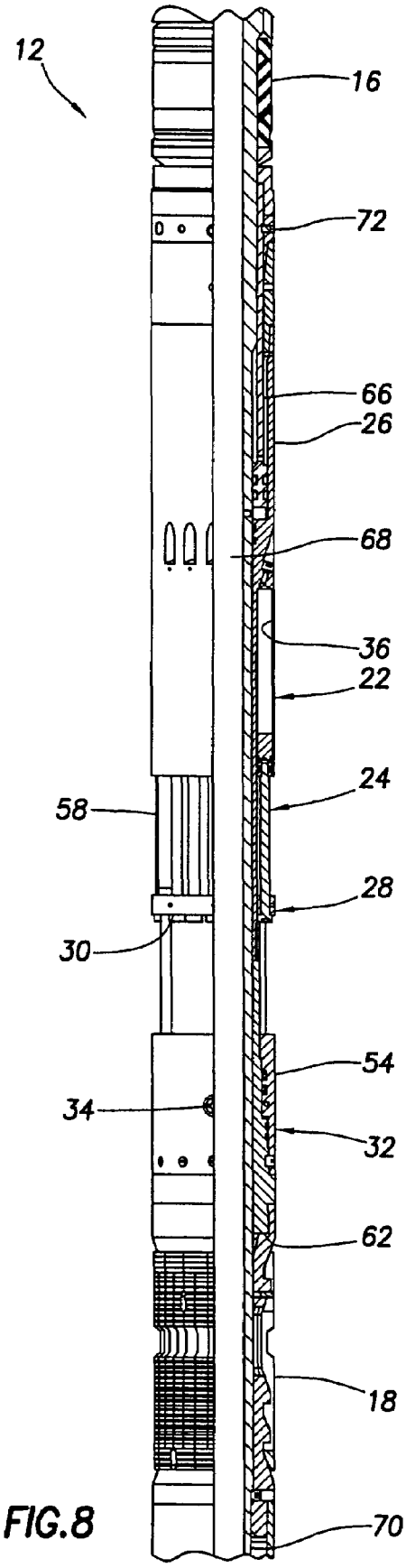
FIG. 8 is a quarter-sectional view of the packer, illustrating a piston relationship to the force transmission arrangement.

Referring additionally now to FIGS. 7 & 8, the packer 12 is depicted with the actuator 22 installed therein. In FIG. 8, a quarter-sectional view shows one of the pistons 24 received in its respective bore 36. In FIG. 7, a quarter-sectional view shows one of the members 58 reciprocably received in one of the openings 60 formed through the structure 26. Note that the upper end 64 of each member 58 is adjacent a lower end of an annular piston 66.

When the members 58 displace upwardly, the piston 66 will be displaced upwardly by the members and will apply a compressive force to the seal elements 16, causing them to extend outwardly into sealing engagement with the wellbore 14. The piston 66 provides a backup, in case the other pistons 24 fail to generate enough force (for example, if one or more of the pistons 24 malfunctions) to displace the members 58 upward and compress the seal elements 16 sufficiently. To utilize the piston 66 as a backup, a pressure differential is applied from an interior flow passage 68 (formed longitudinally through an inner tubular mandrel 70 of the packer 12) to an exterior of the packer. When a sufficiently large pressure differential is applied, shear screws 72 will shear and the piston 66 will be displaced upwardly by the pressure differential to compress the seal elements 16.

The lower end 62 of the actuator 22 abuts the slip assembly 18. When the actuator 22 elongates (between the upper ends 64 of the members 58 and the lower end 62 of the actuator), a downwardly directed force is applied from the lower end of the actuator to the slip assembly 18. This downwardly directed force causes the slip assembly 18 to extend outward into gripping engagement with the wellbore 14.

Note that, because the actuator 22 is positioned between the seal elements 16 and the slip assembly 18, the actuator is able to apply a compressive force to the seal elements and to the slip assembly 18, without the need for the force to be transmitted through one of these to get to the other. In addition, the actuator 22 is preferably not secured directly to the mandrel 70, but is instead reciprocably mounted on the exterior of the mandrel. Thus, when the actuator 22 elongates, the same force applied upwardly by the actuator via the members 58 toward the seal elements 16 is also applied downwardly by the actuator via the lower end 62 toward the slip assembly 18 (i.e., the forces are equal, but oppositely directed).

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An actuator for use in a well packer, the actuator comprising:

multiple pistons;

multiple bores, each of the pistons being received in a respective one of the bores;

a force transmission device, each of the pistons being releasably coupled to the force transmission device; and a setting initiation device which applies a first biasing force to the force transmission device in response to pressure in the well, the first biasing force being greater than, and oppositely directed relative to, a second biasing force applied to the force transmission device by the pistons in response to pressure in the well.

2. The actuator of claim 1, wherein displacement of each of the pistons in a longitudinal direction causes displacement of the force transmission device in the same direction, but the force transmission device is displaceable in the longitudinal direction relative to each of the pistons.

3. The actuator of claim 1, wherein displacement of each of the pistons in a longitudinal direction causes displacement of the force transmission device in the same direction, but the force transmission device is displaceable in the longitudinal direction by less than all of the pistons.

4. The actuator of claim 1, wherein application of a predetermined pressure to the actuator causes the first biasing force to become less than the second biasing force, thereby permitting the second biasing force to cause displacement of the force transmission device.

5. The actuator of claim 1, wherein the pistons are capable of displacing the force transmission device at a pressure of greater than 19,000 pounds per square inch in the well.

6. The actuator of claim 1, wherein the pistons are circumferentially spaced apart from each other.

7. The actuator of claim 1, wherein the bores are formed in a generally annular shaped structure.

8. The actuator of claim 7, wherein the structure encircles an inner tubular mandrel of the packer.

9. The actuator of claim 8, wherein the structure is free of any direct attachment to the mandrel.

10. The actuator of claim 8, wherein the structure is reciprocably displaceable on the mandrel.

11. The actuator of claim 7, wherein the force transmission device extends longitudinally across the structure.

12. The actuator of claim 7, wherein the force transmission device extends longitudinally through the structure.

13. The actuator of claim 7, wherein the force transmission device includes at least one elongated member which extends through at least one opening formed longitudinally through the structure.

14. The actuator of claim 7, wherein the force transmission device includes multiple elongated members which extend through multiple respective openings formed longitudinally through the structure.

15. The actuator of claim 14, wherein the openings are circumferentially spaced apart from each other in the structure.

16. The actuator of claim 14, wherein the openings are circumferentially spaced apart from the bores in the structure.

17. The actuator of claim 1, wherein the force transmission device is displaceable to set the packer by less than all of the pistons.

18. The actuator of claim 1, wherein the force transmission device is releasable from each of the pistons during actuation of the actuator.

19. The actuator of claim 1, wherein the actuator is positioned longitudinally between an outwardly extendable seal element of the packer and a slip assembly of the packer.

20. The actuator of claim 1, wherein the force transmission device includes a ring, each of the pistons being capable of independently applying a biasing force to the ring in response to pressure in the well.

21. The actuator of claim 20, wherein each of the pistons has an elongated extension extending through a respective one of multiple openings formed through the ring.

22. The actuator of claim 21, wherein the openings are circumferentially spaced apart from each other in the ring.

23. The actuator of claim 21, wherein a shoulder formed on each of the extensions prevents displacement of the ring relative to each of the pistons in a first longitudinal direction, but permits displacement of the ring relative to each of the pistons in a second longitudinal direction opposite to the first direction.

24. The actuator of claim 20, wherein the force transmission device further comprises multiple elongated members, displacement of the ring by the pistons causing displacement of the members.

25. The actuator of claim 24, wherein the pistons and the members displace in a same longitudinal direction in response to pressure applied to the actuator.

26. The actuator according to claim 24, wherein the pistons and members are circumferentially spaced apart from each other in an annular shaped structure.

27. A method of setting a packer in a subterranean well, the method comprising the steps of:

increasing pressure on the packer in the well, including admitting pressure through a rupture disc of the packer; and displacing multiple pistons relative to respective multiple bores of an actuator of the packer in response to the pressure increasing step, thereby setting the packer in the well.

28. The method of claim 27, wherein the displacing step further comprises displacing a force transmission device with at least one of the pistons.

29. The method of claim 28, wherein the displacing step further comprises independently applying a biasing force to the force transmission device with each of the pistons.

30. The method of claim 28, wherein in the displacing step, each of the pistons is releasably coupled to the force transmission device.

31. The method of claim 28, wherein in the displacing step, each of the pistons is displaceable relative to the force transmission device.

32. The method of claim 27, wherein the pressure increasing step further comprises increasing to a pressure greater than 19,000 pounds per square inch applied to the packer in the well.

33. The method of claim 27, wherein the pressure increasing step further comprises exposing a chamber of the packer to pressure in the well, the chamber being at a pressure less than hydrostatic pressure in the well at the actuator prior to the pressure increasing step.

34. The method of claim 33, wherein the exposing step further comprises releasing a first biasing force applied in an opposite direction from a second biasing force applied by each of the pistons.

35. The method of claim 34, further comprising the step of applying the first and second biasing forces to a force transmission device of the packer.

36. The method of claim 35, wherein the applying step further comprises extending an extension of each piston through a respective one of multiple openings formed through a portion of the force transmission device.

37. The method of claim 36, wherein in the extending step, the portion of the force transmission device is a ring which encircles an inner mandrel of the packer.

38. The method of claim 27, further comprising the step of reciprocably mounting the actuator on an inner mandrel of the packer, so that the actuator is displaceable relative to the mandrel.

39. The method of claim 27, further comprising the step of positioning the actuator between an outwardly extendable seal element of the packer and a slip assembly of the packer.

40. A packer for use in a subterranean well, the packer comprising:

an actuator for setting the packer, the actuator including multiple pistons circumferentially spaced apart from each other along a circumference; and an outwardly extendable seal element and a slip assembly, and wherein the actuator is positioned longitudinally between the seal element and the slip assembly.

41. The packer of claim 40, wherein each of the pistons is received in a respective one of multiple bores formed in a single structure of the packer.

42. The packer of claim 40, further comprising a force transmission device coupled to each of the pistons.

43. The packer of claim 42, wherein the force transmission device is displaceable to set the packer by less than all of the pistons.

44. The packer of claim 42, wherein the force transmission device is releasable from each of the pistons during actuation of the actuator to set the packer.

45. The packer of claim 42, wherein the force transmission device extends across a structure having the pistons received therein.

46. The packer of claim 45, wherein the force transmission device extends through at least one opening formed through the structure, and wherein the pistons are received in respective ones of multiple bores formed in the structure.

47. The packer of claim 46, wherein the structure encircles an inner tubular mandrel of the packer.

48. The packer of claim 47, wherein the actuator is free of any direct attachment to the mandrel.

49. A packer for use in a subterranean well, the packer comprising:

an outwardly extendable seal element;

a slip assembly; and an actuator for setting the packer, the actuator being positioned longitudinally between the seal element and the slip assembly , the actuator including multiple pistons circumferentially spaced apart from each other, and wherein each of the pistons is received in a respective one of multiple bores formed in a single structure of the packer.

50. The packer of claim 49, further comprising a force transmission device coupled to each of the pistons.

51. A packer for use in a subterranean well, the packer comprising:

an outwardly extendable seal element;

a slip assembly;

an actuator for setting the packer, the actuator being positioned longitudinally between the seal element and the slip assembly, and the actuator including multiple pistons circumferentially spaced apart from each other; and a force transmission device coupled to each of the pistons, the force transmission device is being displaceable to set the packer by less than all of the pistons.

52. A packer for use in a subterranean well, the packer comprising:

an outwardly extendable seal element;

a slip assembly;

an actuator for setting the packer, the actuator being positioned longitudinally between the seal element and the slip assembly, and the actuator including multiple pistons circumferentially spaced apart from each other; and a force transmission device coupled to each of the pistons, the force transmission device being releasable from each of the pistons during actuation of the actuator to set the packer.

53. The packer of claim 50, wherein the force transmission device extends across a structure having the pistons received therein.

54. A packer for use in a subterranean well, the packer comprising:

an outwardly extendable seal element;

a slip assembly;

an actuator for setting the packer, the actuator being positioned longitudinally between the seal element and the slip assembly, and the actuator including multiple pistons circumferentially spaced apart from each other; and a force transmission device coupled to each of the pistons, the force transmission device extending across a structure having the pistons received therein, the force transmission device extending through at least one opening formed through the structure, and wherein the pistons are received in respective ones of multiple bores formed in the structure.

55. The packer of claim 54, wherein the structure encircles an inner tubular mandrel of the packer.

56. The packer of claim 55, wherein the actuator is free of any direct attachment to the mandrel.

57. The packer of claim 49 wherein the actuator applies force to the seal assembly in a first direction to outwardly extend the seal assembly, and wherein the actuator applies force to the slip assembly in a second direction opposite to the first direction to outwardly extend the slip assembly, when the packer is set.

* * * * *